US007438488B2

(12) United States Patent
Goeree et al.

(10) Patent No.: US 7,438,488 B2
(45) Date of Patent: Oct. 21, 2008

(54) PRINTER WITH RECIPROCATING CARRIAGE AND A TWO-STAGE FRAME STRUCTURE

(75) Inventors: Barry B. Goeree, Venlo (NL); Henk-Jan Zwiers, Venlo (NL); Frank J. H. Nottelman, Belfeld (NL); Luc G. T. Dircks, Leunen (NL); Bas W. J. J. A. Van Dorp, Eindhoven (NL)

(73) Assignee: OCE-Technologies B.V., Venlo (NL)

( * ) Notice: Subject to any disclaimer, the term of this patent is extended or adjusted under 35 U.S.C. 154(b) by 300 days.

(21) Appl. No.: 11/312,359

(22) Filed: Dec. 21, 2005

(65) Prior Publication Data

US 2006/0133880 A1 Jun. 22, 2006

(30) Foreign Application Priority Data

Dec. 22, 2004 (EP) ..... 04106833

(51) Int. Cl.
*B41J 29/02* (2006.01)
*B41J 11/00* (2006.01)

(52) U.S. Cl. ..... 400/691; 347/104

(58) Field of Classification Search ..... 347/104–106
See application file for complete search history.

(56) References Cited

U.S. PATENT DOCUMENTS 3,989,131 A * 11/1976 Knirsch et al. ..... 400/120.16
4,177,471 A 12/1979 Mitchell
4,268,177 A * 5/1981 Veale ..... 400/55
4,300,847 A * 11/1981 Hoffman et al. ..... 400/196.1
4,444,519 A * 4/1984 Howell et al. ..... 400/82
4,459,054 A * 7/1984 Dollenmayer ..... 400/185
4,591,284 A * 5/1986 Lim et al. ..... 400/691
4,773,773 A * 9/1988 Itoh ..... 400/59
4,795,284 A * 1/1989 Yumoto et al. ..... 400/352
5,053,791 A * 10/1991 Baek et al. ..... 346/138
5,209,590 A * 5/1993 Tsukuda et al. ..... 400/636.1
5,563,591 A * 10/1996 Jacobs et al. ..... 341/13
5,879,091 A * 3/1999 De Ambrogio et al. ..... 400/656
5,907,337 A * 5/1999 Tajika et al. ..... 347/40
6,227,642 B1 * 5/2001 Hanabusa et al. ..... 347/19
6,296,340 B1 * 10/2001 Tajika et al. ..... 347/12
6,899,751 B2 * 5/2005 Arita et al. ..... 106/31.27

FOREIGN PATENT DOCUMENTS

EP 0 030 271 A2 6/1981
JP 59-062171 A 9/1984
JP 2002315260 A * 10/2002
JP 2004276297 A * 10/2004

* cited by examiner

*Primary Examiner*—Jill E. Culler
*Assistant Examiner*—'Wyn' Q Ha
(74) *Attorney, Agent, or Firm*—Birch, Stewart, Kolasch & Birch, LLP

(57) ABSTRACT

A printer including: a frame composed of a lower frame and an upper frame supported on the lower frame, a platen rotatably supported in the upper frame for advancing a recording medium, a guide rail extending in parallel with an axial direction (Y) of the platen, a carriage guided at the guide rail and carrying a printhead, and a drive mechanism adapted to drive the carriage reciprocatingly along the guide rail, wherein the drive mechanism is directly supported in said axial direction (Y) by the lower frame.

5 Claims, 2 Drawing Sheets

CONVENTIONAL ART

PRINTER WITH RECIPROCATING CARRIAGE AND A TWO-STAGE FRAME STRUCTURE

This non-provisional application claims priority under 35 U.S.C. § 119(a) on Patent Application No. 04106833.9 filed in Europe on Dec. 22, 2004, which is herein incorporated by reference.

BACKGROUND OF THE INVENTION

The present invention relates to a printer including a frame composed of a lower frame and an upper frame supported on the lower frame, a platen rotatably supported in the upper frame for advancing a recording medium, a guide rail extending in parallel with an axial direction of the platen, a carriage guided at the guide rail and carrying a printhead, and a drive mechanism adapted to drive the carriage reciprocatingly along the guide rail.

A typical example of a printer of this type is an ink jet printer having a printhead or printheads adapted to expel droplets of liquid ink onto the recording medium that is advanced over the platen. The timings at which the nozzles of the printhead are energized must be accurately synchronized with the movement of the carriage relative to the recording medium. To this end, the carriage may be equipped with a detector for reading markings on a ruler. However, especially in a large format printer with a high throughput, the reciprocating carriage must be accelerated and decelerated rapidly, and this has the effect that the drive mechanism is subject to relatively high forces of inertia which must be absorbed by the frame structure. For this reason, the frame of a conventional printer has a very stiff construction so as to avoid distortions and vibrations which would degrade the print quality. This, however increases the costs and weight of the frame structure.

SUMMARY OF THE INVENTION

The present invention provides a printer which has a simple construction and nevertheless permits a high print quality, especially in high-speed printing. According to the present invention, a printer of the type indicated above is provided, wherein the drive mechanism is directly supported in the axial direction by the lower frame. Thus, when the drive mechanism accelerates the carriage and is consequently subject to reaction forces, these forces will directly be absorbed by the lower frame, and at least a major portion of these forces will bypass the upper frame which supports the platen. Since it is the platen which determines the position of the recording medium in the main scanning direction, i.e., the direction of movement of the carriage, an accurate and stable position of the platen is necessary for obtaining a good image register. The present invention therefore has the advantage that distortions or vibrations of the upper frame, which would influence the position of the platen, are reduced significantly. Thus, it is possible to achieve a high print quality even with an inexpensive and lightweight construction of the upper frame. Moreover, since the accurate upper frame is largely shielded against the reaction forces, the operation of the printer will be more predictable and reproducible.

Since the forces of inertia act in the direction of movement of the carriage, the mechanical link between the drive mechanism and the lower frame needs to be stiff only in that direction but may be compliant in the plane normal to that direction. If, for example, X is the direction in which the recording medium is advanced (sub-scanning direction), Y is the main scanning direction in which the carriage reciprocates, and Z is the vertical direction, the mechanical link between the drive mechanism and the lower frame may be formed by a leaf spring that is oriented in the Y-Z-plane. The drive mechanism may also be supported on the upper frame by means of a mounting structure which is stiff in the X- and Z-directions but may be compliant in the Y-direction, so that the position of the drive mechanism in the X- and Z-directions is determined by the accurate upper frame.

It is convenient that the drive mechanism, e.g., a belt type mechanism, is directly mounted on the guide rail for the carriage. Then, the drive mechanism may rigidly be attached to the guide rail, and the mechanical link or leaf spring may be provided between the guide rail and the lower frame. Even if the guide rail is subject to minor displacements or vibrations that may be induced by the reaction forces, this will not necessarily degrade the image quality, because it is the position of the carriage rather than the position of the guide rail that is important for obtaining a good image register in the Y-direction. For example, the components of the drive mechanism connecting the carriage to the guide rail may have a certain inherent resilience, and this resilience in conjunction with the mass of inertia of the carriage will prevent any possible vibrations in the support structure for the guide rail from being transmitted to the carriage. The accuracy of image registration may be improved further by utilizing a detection system for the Y-position of the carriage, which measures the position of the carriage not in relation to the guide rail but directly in relation to the recording medium or the platen.

BRIEF DESCRIPTION OF THE DRAWINGS

A preferred embodiment of the present invention will now be described in conjunction with the drawings, wherein.

DETAILED DESCRIPTION OF THE INVENTION

Figure 1:
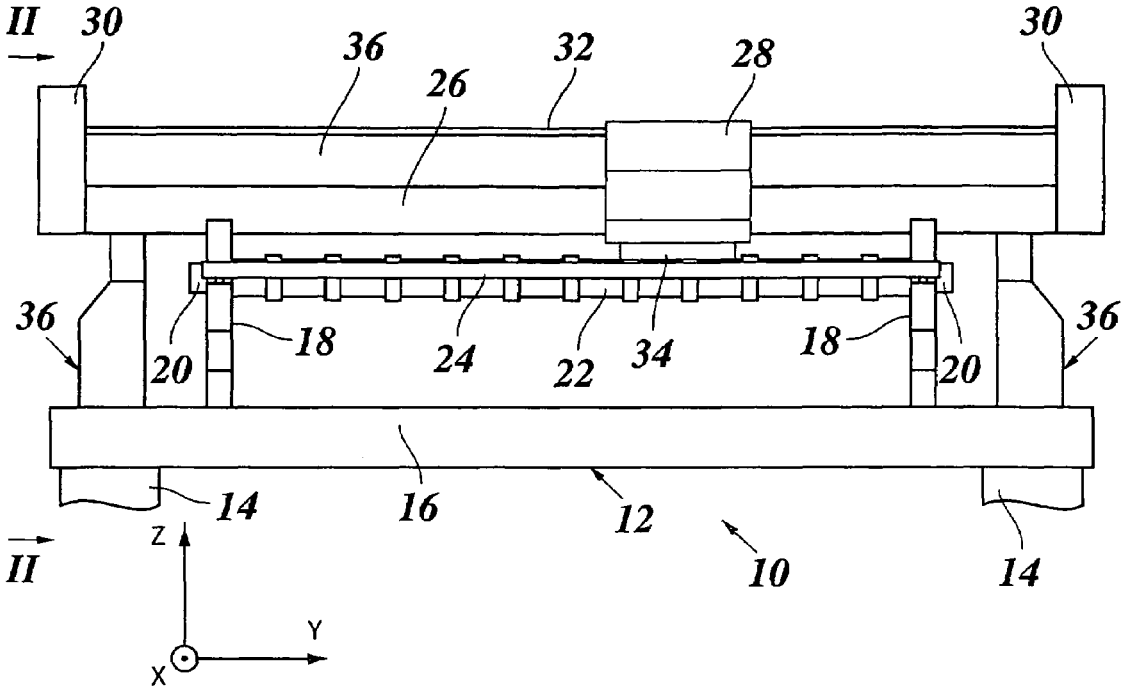
FIG. 1 is a front view of a printer according to the present invention.

The printer shown in FIG. 1 includes a frame 10 which is composed of a lower frame 12 formed by two uprights 14 and two cross-bars 16, and an upper frame that is formed by two plate-like frame members 18 projecting upwardly from the cross-bars 16.

A bearing assembly is formed by two bearings 20 which rotatably support a platen 22 between the two frame members 18. A sheet support plate 24 is horizontally supported on the two frame members 18 and serves to support a sheet of a recording medium (not shown) which is advanced in the X-direction (normal to the plane of the drawing in FIG. 1) by means of the platen 22. A drive mechanism for the platen 22 has not been shown here for simplicity.

A guide rail 26 rests on the top ends of the frame members 18 and extends in parallel with the axial direction Y of the platen 22. A carriage 28 is guided on the guide rail 26 and is driven to move back and forth along the guide rail by means of a drive mechanism 30 connected to the carriage 28 by an endless belt 32, for example. The carriage 28 has a portion extending over the sheet support plate 24, and a printhead 34 is mounted on the bottom side of the carriage portion so as to face the sheet that is advanced over the sheet support plate 24. The printhead 34 may for example be a hot melt ink jet printhead.

A detection and control system, which may have a conventional design and has not been shown here, detects the Y-position of the carriage 28 and determines the timings at which the print units or nozzles of the printhead 34 are energized while the carriage moves across the recording medium.

The guide rail 26 rests on top surfaces of the frame members 18 and is thereby accurately positioned in the X-direction, i.e., the direction in which the recording medium advances, and in the Z-direction. In the Y-direction, however, the guide rail 26 is rigidly supported by mechanical links 36 which connect the guide rail directly to the lower frame 12. In order to permit the printhead 34 to travel over the entire width of the recording medium, the guide rail 26 projects beyond the ends of the platen 22 on both sides. The mechanical links 36 are ranged outside of the frame members 18 of the upper frame. In the example shown, they are arranged directly above the uprights 14. Thus, when the drive mechanism 30 and the guide rail 26 are subject to reaction forces that are caused by the acceleration and deceleration of the carriage 28, these forces are directly introduced into the uprights 14, without causing any deflection of the upper frame members 18 nor any bending of the cross-bars 16.

Figure 2:
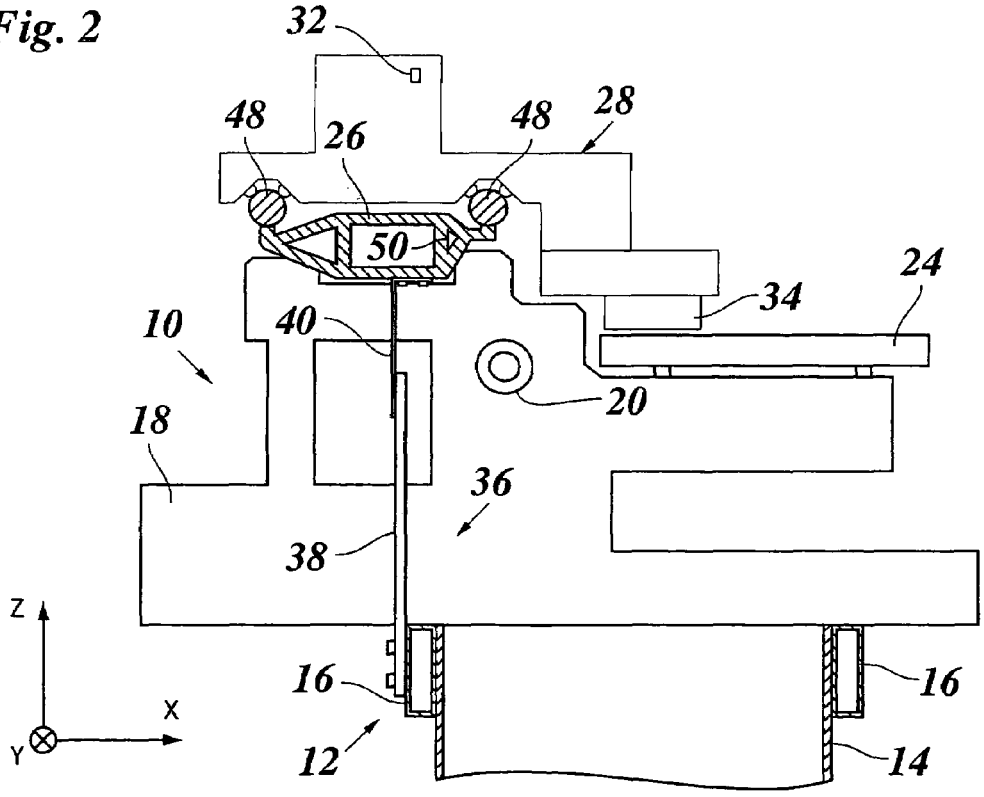
FIG. 2 is an elevational view of the printer taken along line II-II in FIG. 1.

As is shown in FIG. 2, the mechanical link 36 is formed by a plate 38 that has been flanged to a side surface of one of the cross-bars 16, and a folded leaf spring 40 connecting the plate 38 to the bottom of the guide rail 26. Thus, the link 36 is flexible in the X-direction but stiff in the Y-direction.

The sheet support plate 24 is supported on horizontally projecting arms of the upper frame members 18. Thus, not only the platen 22 but also the sheet support plate 24 is shielded from the acceleration forces of the carriage 28.

As is further shown in FIG. 2, the guide rail 26 is formed by a profile member which supports two cylindrical rods 48 on which the carriage 28 is supported and guided with roller bearings.

The main advantage of the frame structure described above will now be explained in conjunction with FIGS. 3 and 4.

Figure 3:
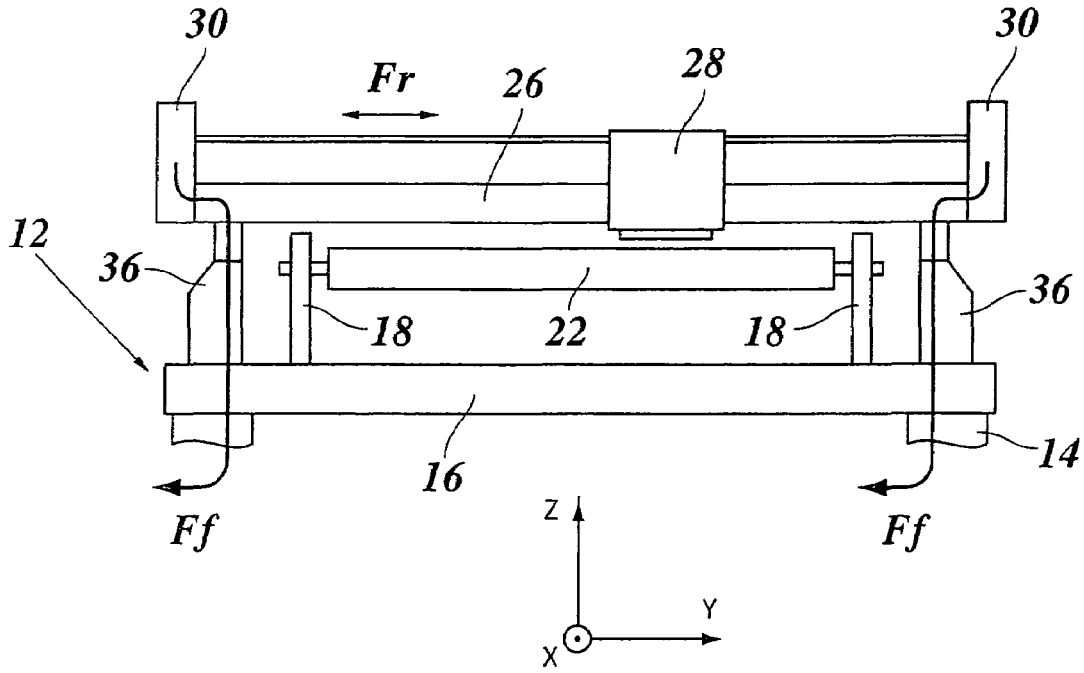
FIG. 3 is a schematic front view of another embodiment of the printer according to the present invention.

In FIG. 3, a double-headed arrow Fr indicates the reaction forces that act upon the drive mechanism 30 and the guide rail 26 when the carriage 28 is accelerated. Arrows Ff indicate, how these reaction forces are guided through the frame of the printer. Since the forces are directly introduced into the lower frame 12 or, more exactly, into the uprights 14 thereof, and bypass the upper frame members 18, any distortions or vibrations that may be caused by these forces will have no substantial influence on the upper frame members 18 and on the platen 22. Thus, although the upper frame must fulfill high accuracy demands, the upper frame may have a simple, inexpensive and lightweight construction. Moreover, the upper frame may be designed to have a high stiffness particularly in X- and Z-direction. On the other hand, the mechanical links 36 may be specifically designed to have a high stiffness in the Y-direction and may therefore also have a simple and inexpensive construction.

Figure 4:
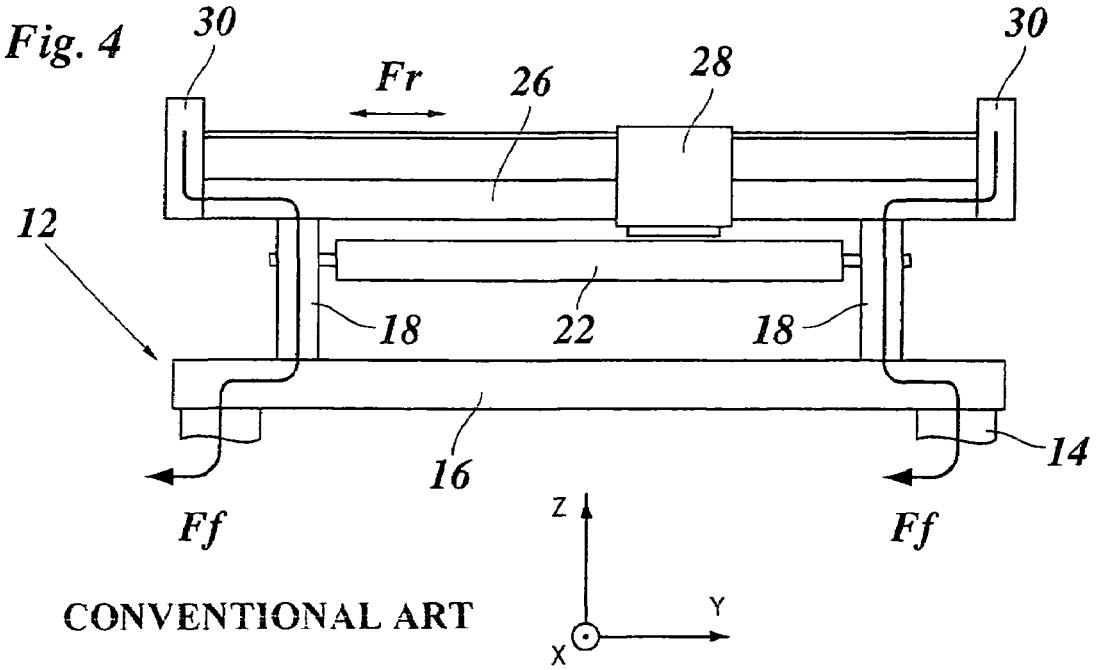
FIG. 4 is a schematic view analogous to FIG. 3, for a printer according to a comparison example.

For comparison, FIG. 4 illustrates a conventional design in which the forces Ff are guided through the frame members 18 of the upper frame. Here, the frame members 18 must be stiff in all three directions. Even then, distortions or vibrations induced by the reaction forces Fr will influence the Y-position of the platen 22 (and also of the sheet support plate 24 which has not been shown in FIGS. 3 and 4) and will therefore have an adverse effect on the image register.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printer comprising:

a frame including a lower frame and an upper frame supported on the lower frame, a platen rotatably supported in the upper flame for advancing a recording medium, a guide rail extending in parallel with an axial direction (Y) of the platen, a carriage guided at the guide rail and carrying a printhead, and a drive mechanism operatively connected to the carriage reciprocatingly drives the carriage along the guide rail, wherein the guide rail is supported in said axial direction (Y) by the lower frame via plate-like mechanical links which are oriented in parallel with the axial direction (Y) of the platen, said mechanical links being flexible in a direction (X), perpendicular to the axial direction (Y).

2. The printer according to claim 1, wherein the upper frame supports the drive mechanism in a direction (X, Z), normal to said axial direction (Y).

3. The printer according to claim 1, wherein said mechanical links comprise leaf springs.

4. The printer according to claim 1, wherein the drive mechanism and the guide rail form a rigid unit which is directly supported on the lower frame in the axial direction (Y).

5. The printer according to claim 1, wherein a sheet support plate, which supports the recording medium that is being advanced by the platen, is rigidly supported by the upper frame.

* * * * *